US007641484B2

(12) United States Patent
Cha et al.

(10) Patent No.: US 7,641,484 B2
(45) Date of Patent: Jan. 5, 2010

(54) CONNECTOR COVER STRUCTURE OF BILL STORAGE BOX

(75) Inventors: Jin Hwan Cha, Gyeonggi-do (KR); Hyun Soo Jang, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 45 days.

(21) Appl. No.: 11/961,590

(22) Filed: Dec. 20, 2007

(65) Prior Publication Data

US 2008/0287015 A1 Nov. 20, 2008

(30) Foreign Application Priority Data

Dec. 29, 2006 (KR) ..... 10-2006-0139012

(51) Int. Cl.
*H00R 13/44* (2006.01)

(52) U.S. Cl. ..... 439/138

(58) Field of Classification Search ..... 439/135–138, 439/142

See application file for complete search history.

(56) References Cited

U.S. PATENT DOCUMENTS 6,004,147 A * 12/1999 Don-Yehiya ..... 439/138
6,394,826 B1 * 5/2002 Baxter et al. ..... 439/137
6,454,580 B1 * 9/2002 Hwang ..... 439/138
2004/0067667 A1 * 4/2004 Kuroki ..... 439/138
2004/0115978 A1 * 6/2004 Hedayat et al. ..... 439/136
2006/0063407 A1 * 3/2006 Fan ..... 439/137
2006/0094272 A1 * 5/2006 Healy ..... 439/137
2008/0026616 A1 * 1/2008 Cummings et al. ..... 439/142

* cited by examiner

*Primary Examiner*—Edwin A. Leon
*Assistant Examiner*—Larisa Tsukerman
(74) *Attorney, Agent, or Firm*—Fish & Richardson P.C.

(57) ABSTRACT

Disclosed is a connector cover structure of a bill storage box, which can prevent a connector for electric power supply from being exposed to dust or foreign substances, during the process of mounting or dismounting a cassette box in or from the bill storage box. The disclosed connector cover structure includes: a connector-fixing bracket fixedly assembled with the connector, and having assembling holes formed through opposite sides of the connector-fixing bracket; a cover having a hinge shaft rotatably fitted in the assembling holes of the connector-fixing bracket, thereby covering a connecting pin; a contact part protruded by a certain length in front of one end of the cover, and having a curved shape; and elastic springs fixedly assembled to the hinge shaft in such a manner that the cover can be returned to its original position. Accordingly, it is possible to prevent poor connection or electrical short circuiting by preventing the exposure of the connector to dust or foreign substances.

3 Claims, 10 Drawing Sheets

(a)

(b)

(a)

(b)

(a)

(b)

CONNECTOR COVER STRUCTURE OF BILL STORAGE BOX

TECHNICAL FIELD

The present invention relates to a connector cover structure of a bill storage box, and more particularly to a connector cover structure of a bill storage box, which can prevent a connector for electric power supply from being exposed to dust or foreign substances, during the process of mounting or dismounting a cassette box in or from the bill storage box.

BACKGROUND ART

In general, an automated teller machine (ATM) means an unmanned apparatus for quickly and conveniently providing a variety of financial services except for financial consultation, regardless of time.

The ATM is provided with a built-in billing recycling machine, and the billing recycling machine is provided with a bill storage box for piling up or storing deposit/withdrawal bills.

Herein, a bill storage box realizing only a withdrawal function is called a cassette box. A reflux-type storage box realizing a deposit function as well as the cassette box function is called a recycle box. Also, a storage box for collecting bills which have not been taken by customers or have been determined as abnormal bills is called a reject box.

FIGS. 1 and 2 are a schematic side view and an exploded perspective view illustrating a structure of a general billing recycling machine, and FIG. 3 is a schematic view illustrating an assembly structure of a conventional connector.

Referring to FIG. 1, the ATM 10 includes a billing recycling machine 11 containing a bill storage box 12. The billing recycling machine 11 has rails 15 on both sides of the inside, in such a manner that the bill storage box 12 can be slidably mounted or dismounted in or from the billing recycling machine 11 on the rails 15 in a horizontal direction. The bill storage box 12 is provided with multiple recycle boxes 13, and a cassette box 14.

Referring to FIG. 2, the bill storage box 12 is provided with a door 16 on one end thereof, in such a manner that the cassette box 14 can be mounted to the bill storage box 12 from the lateral side or the upper side. Also, as shown in FIG. 3, a connector 20 includes a male connector 21 provided on the bottom surface of the bill storage box 12 and a female connector 22 provided on the lower lateral surface of the cassette box 14. The male connector 21 and the female connector 22 are assembled with each other, thereby supplying power to a motor (not shown) or various parts included within the cassette box 14.

DISCLOSURE

Technical Problem

The male connector 21 provided on the bottom surface of the bill storage box 12 includes a connecting pin 21*a* directly exposed to external dust or various foreign substances. Accordingly, during the process of mounting or dismounting the cassette box 14, the connector may be poorly connected or be subject to electrical short circuiting.

The present invention has been made to solve the above-mentioned problems, and the present invention provides a connector cover structure of a bill storage box, which can prevent a connector for electric power supply from being exposed to dust or foreign substances, during the process of mounting or dismounting a cassette box in or from the bill storage box.

Technical Solution

In accordance with an aspect of the present invention, there is provided a connector cover structure of a bill storage box including a connector connected or disconnected during a process of mounting or dismounting a cassette box in or from the bill storage box, and a connector conveyor for upwardly and downwardly conveying the connector, the connector cover structure including: a connector-fixing bracket fixedly assembled with the connector, and having assembling holes formed through opposite sides of the connector-fixing bracket; a cover having a hinge shaft rotatably fitted in the assembling holes of the connector-fixing bracket, thereby covering a connecting pin; a contact part protruded by a certain length in front of one end of the cover, and having a curved shape; and elastic springs fixedly assembled to the hinge shaft in such a manner that the cover can be returned to its original position.

Also, the contact part of the cover is disposed on a position where the contact part can come in contact with a contact surface of a cassette box, which is mounted from an upper side or a lateral side.

Also, a lower end portion of the contact part is lower than a center of the hinge shaft of the cover.

Also, the connector-fixing bracket includes stopper pieces formed on opposite sides of the connector-fixing bracket so as to limit rotation of the cover.

ADVANTAGEOUS EFFECTS

As described above, a connector cover structure of a bill storage box according to the present invention prevents a connector from being exposed to dust or foreign substances during the process of mounting or dismounting a cassette box in or from a bill storage box. Therefore, it is possible to prevent poor connection or electrical short circuiting of the connector.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, exemplary embodiments of the present invention will be described with reference to the accompanying drawings.

Herein, the parts corresponding to those of a conventional structure have the same names.

Figure 1:
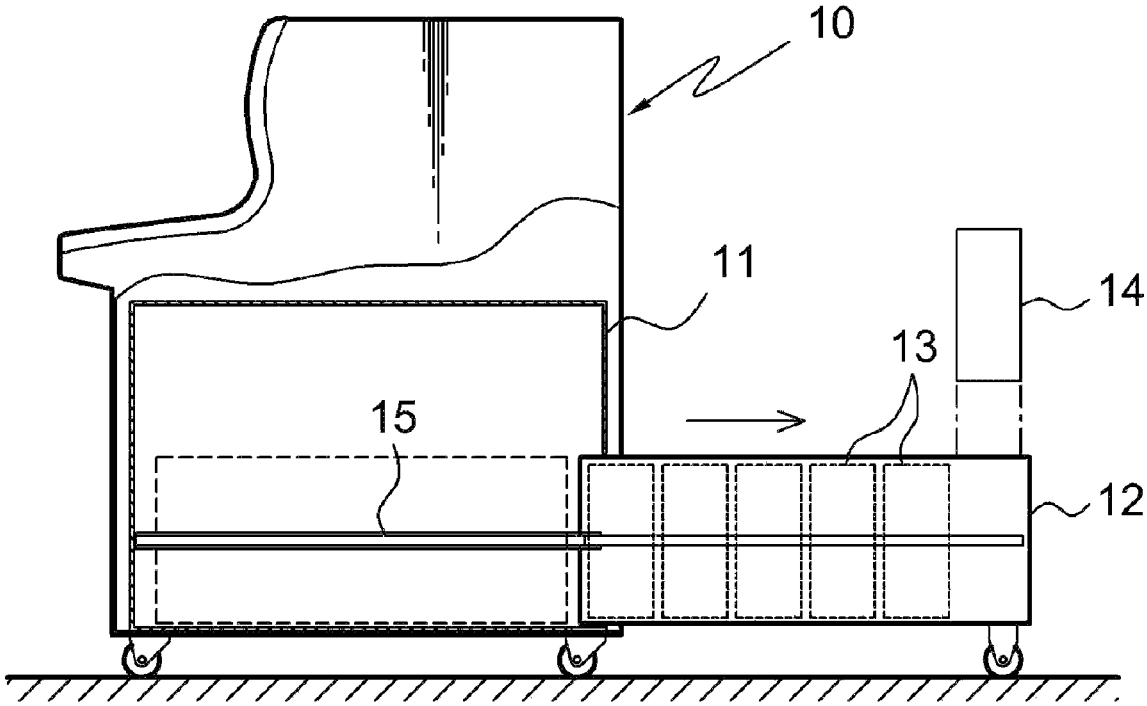
FIGS. 1 and 2 are a schematic side view and an exploded perspective view illustrating a structure of a general billing recycling machine.
Figure 2:
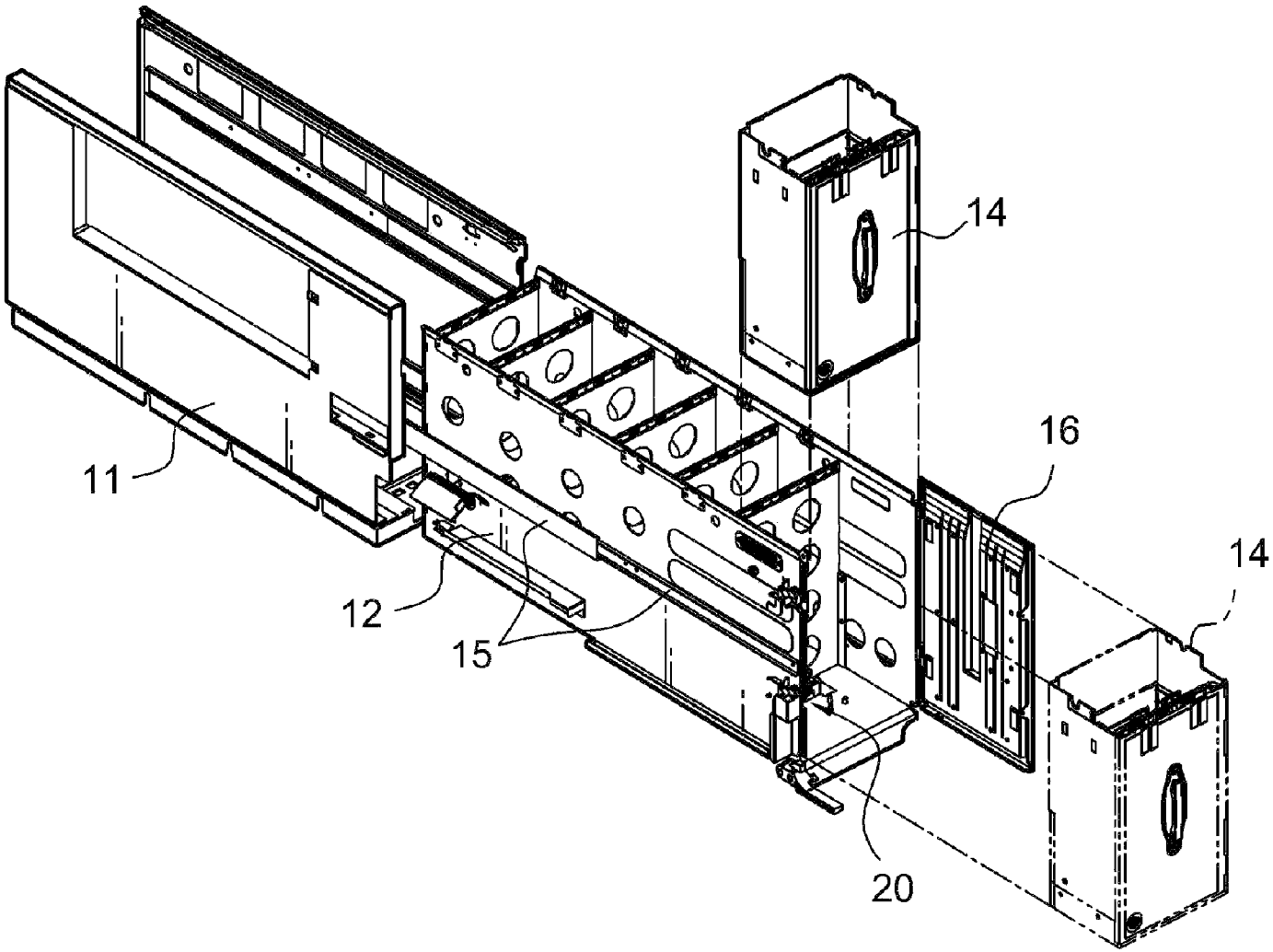
Figure 3:
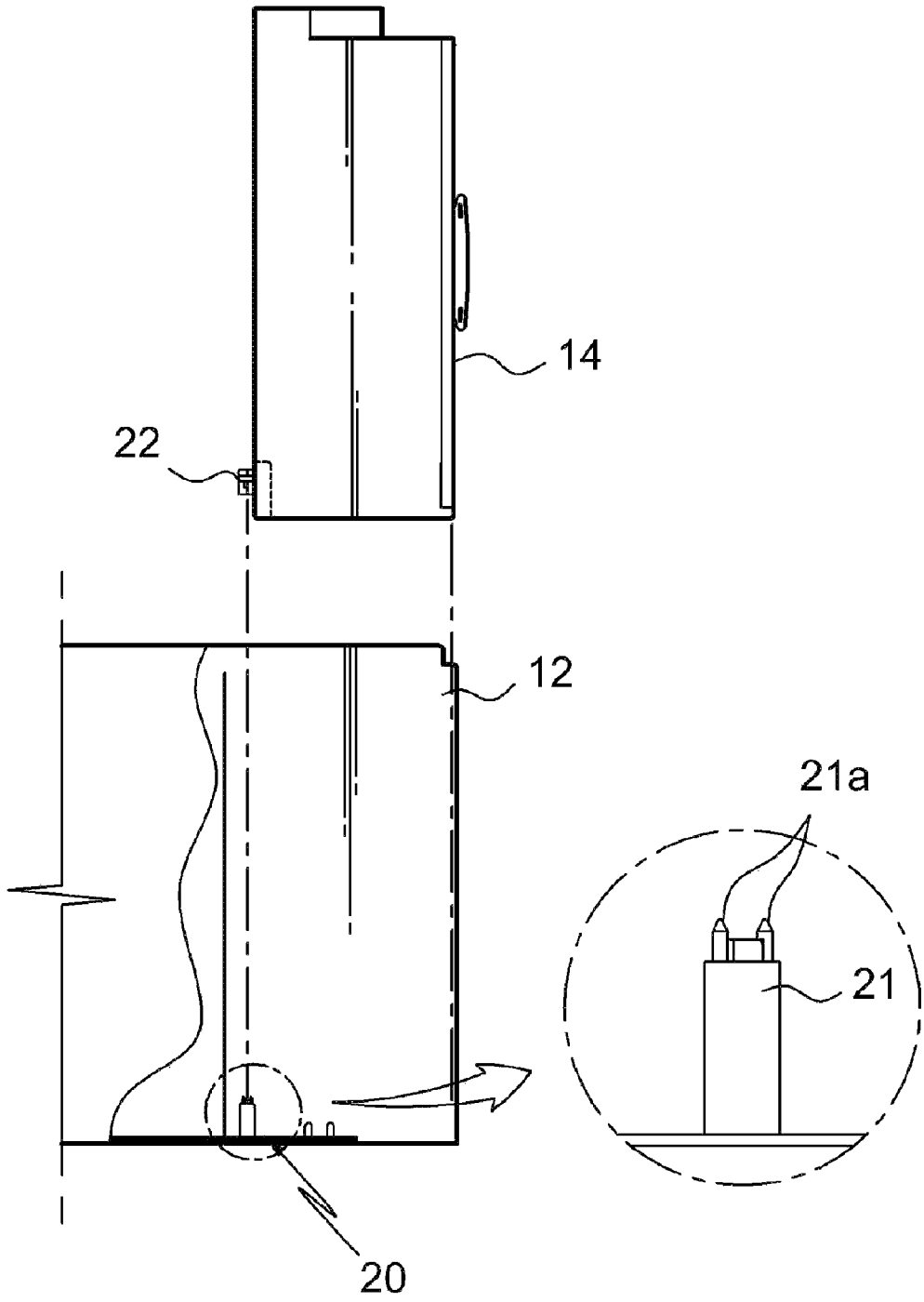
FIG. 3 is a schematic view illustrating an assembly structure of a conventional connector.
Figure 4:
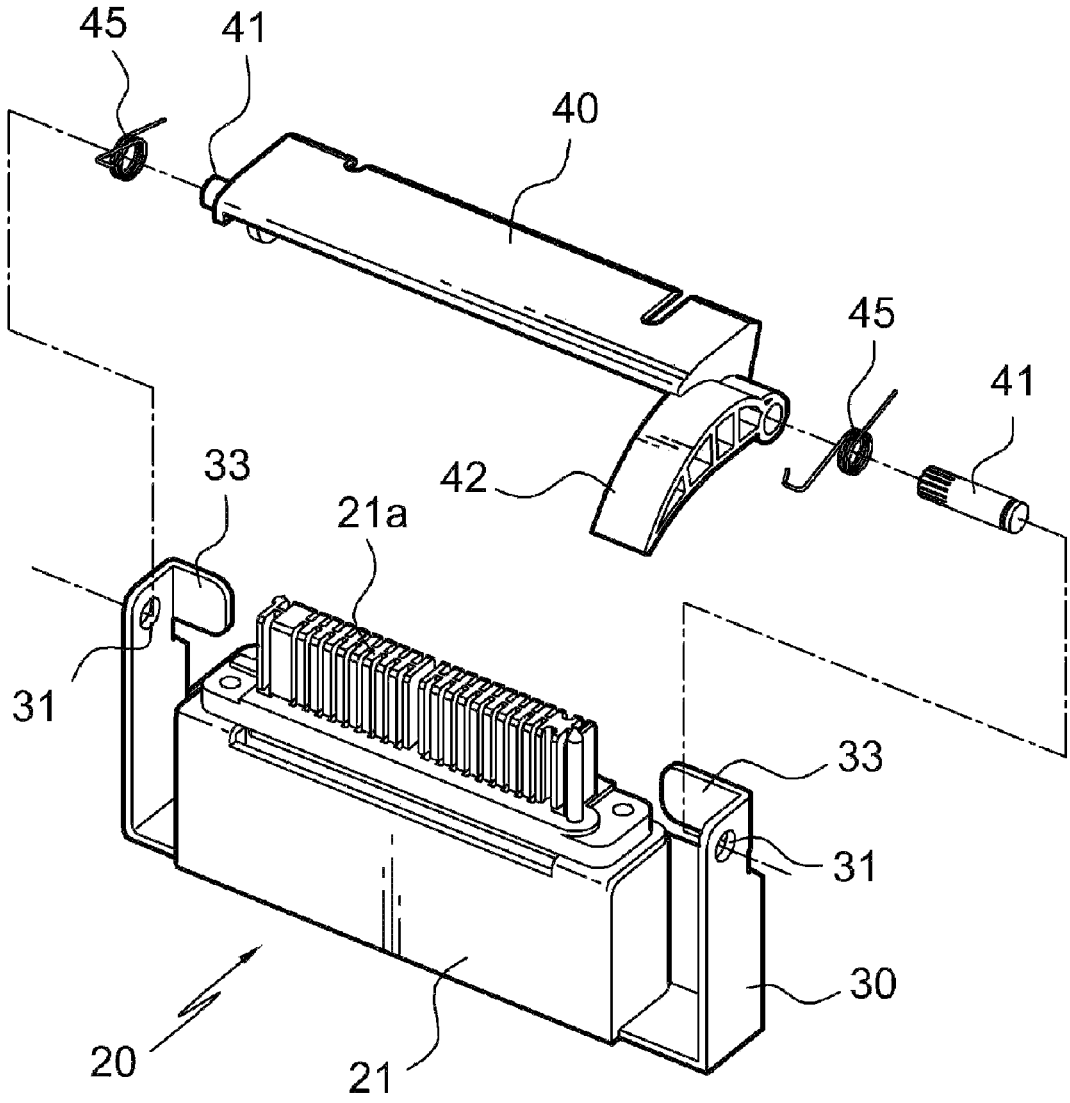
FIG. 4 is an exploded perspective view illustrating a connector cover structure according to the present invention.
Figure 5:
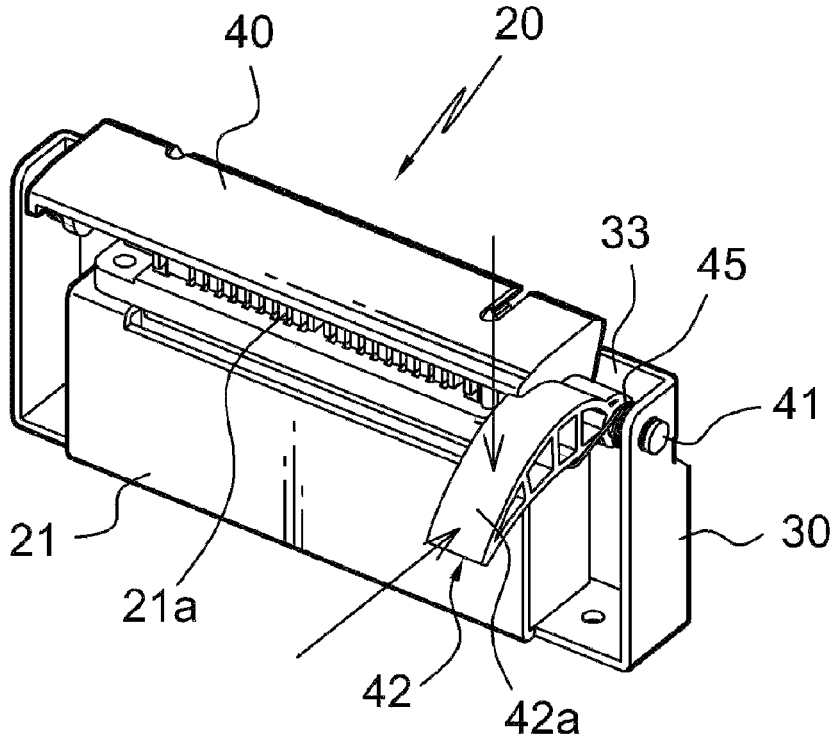
FIGS. 5*a* and 5*b* are perspective views illustrating operational principles of a connector cover according to the present invention.
Figure 5:
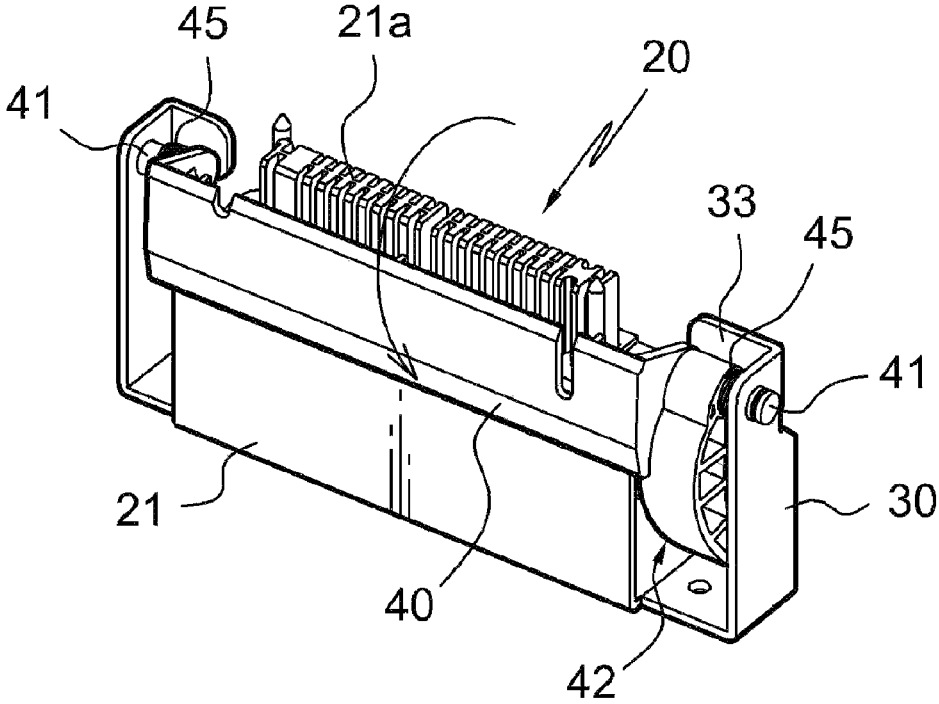
Figure 6:
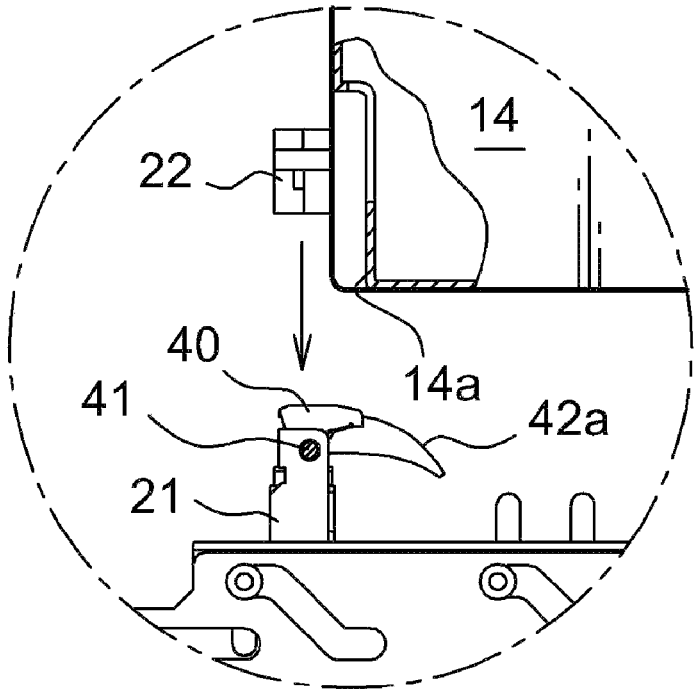
FIGS. 6*a* and 6*b* are enlarged views illustrating a process of assembling a female connector and a male connector.
Figure 6:
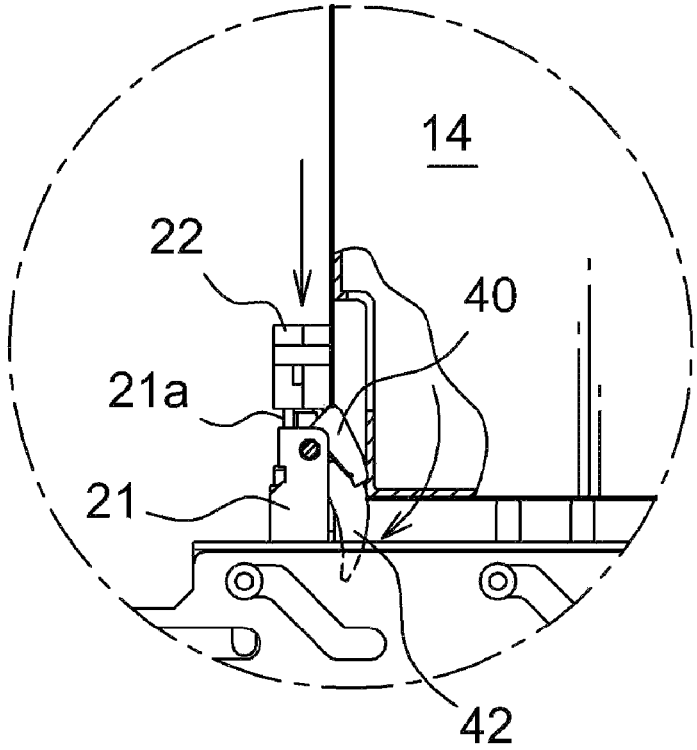

FIG. 4 is an exploded perspective view illustrating a connector cover structure according to the present invention; FIGS. 5*a* and 5*b* are perspective views illustrating operational principles of a connector cover; and FIGS. 6*a* and 6*b* are enlarged views illustrating a process of assembling a female connector and a male connector.

Referring to FIGS. 4, 5*a*, and 5*b*, a connector cover structure according to the present invention includes a connector-fixing bracket 30, a cover 40, and elastic springs 45.

The connector-fixing bracket 30 is fixedly assembled with a male connector 21 (connector), and has assembling holes 31 formed through opposite sides of the bracket. Herein, according to an assembly structure, a female connector 22 (mating connector) instead of the male connector 21 may be assembled.

In the assembly of the cover 40, a hinge shaft 41 on opposite sides is rotatably fitted in the assembling holes 31. Herein, the cover 40 is disposed above a connecting pin 21*a* of the male connector 21, so as to cover and protect the connecting pin 21*a*.

In front of one end of the cover 40, a contact part 42 is protruded by a certain length. Herein, the contact part 42 has a downward curved shape.

The contact part 42 of the cover 40 is disposed on a position where the contact part 42 can come in contact with a contact surface 14*a* of a cassette box 14. (The cassette box 14 mounted from the upper side or the lateral side will be described later.) Accordingly, when the contact surface 14*a* of the vertically mounted cassette box 14 presses the contact part 42 of the cover 40, the cover 40 covering the male connector 21 rotates in one direction, thereby releasing the connecting pin 21*a*.

Also, the lower end portion of the contact part 42 is lower than the center of the hinge shaft 41 of the cover 40, in such a manner that of the contact part 42 can smoothly downwardly rotate by contact with the contact surface 14*a* of the laterally mounted cassette box 14.

Also, there are stopper pieces 33 on opposite sides of the cover 40, so that the rotating angle of the cover 40 can be limited.

The elastic springs 45 (elastic members) are assembled and fixed on the hinge shaft 41 on opposite sides of the cover 40. At the moment when the force pressing the contact part 42 is released, the cover 40 is returned to its original position by elastic force of the elastic springs 45, thereby again covering the connecting pin 21*a* of the male connector 21.

Hereinafter, in a connector cover structure according to the present invention as described above, a case where the cassette box 14 is vertically mounted to a bill storage box 12 will be described with reference to FIGS. 6*a* and 6*b*.

As shown in FIG. 6*a*, during the process of vertically mounting the cassette box 14 to the bill storage box 12, when the contact surface 14*a* of the cassette box 14 presses a contact surface 42*a* of the cover 40, the cover 40 rotates in one direction on the axis of the hinge shaft 41, thereby releasing the covered connecting pin 21*a*. Herein, as shown in FIG. 6*b*, the connecting pin 21*a* of the male connector 21 is released, and at the same time, is connected to the female connector 22 provided on one lateral surface of the vertically mounted cassette box 14.

On the other hand, when the cassette box 14 is upwardly dismounted, the contact part 42 of the cover 40, which has been pressed by the contact surface 14*a* of the cassette box 14, is released. Herein, the cover 40 is returned to its original position by elastic force of the elastic springs 45 fixedly assembled on opposite sides of the cover, thereby again covering the connecting pin 21*a* of the male connector 21. Thus, it is possible to prevent the connector from being exposed to dust or foreign substances.

Figure 7:
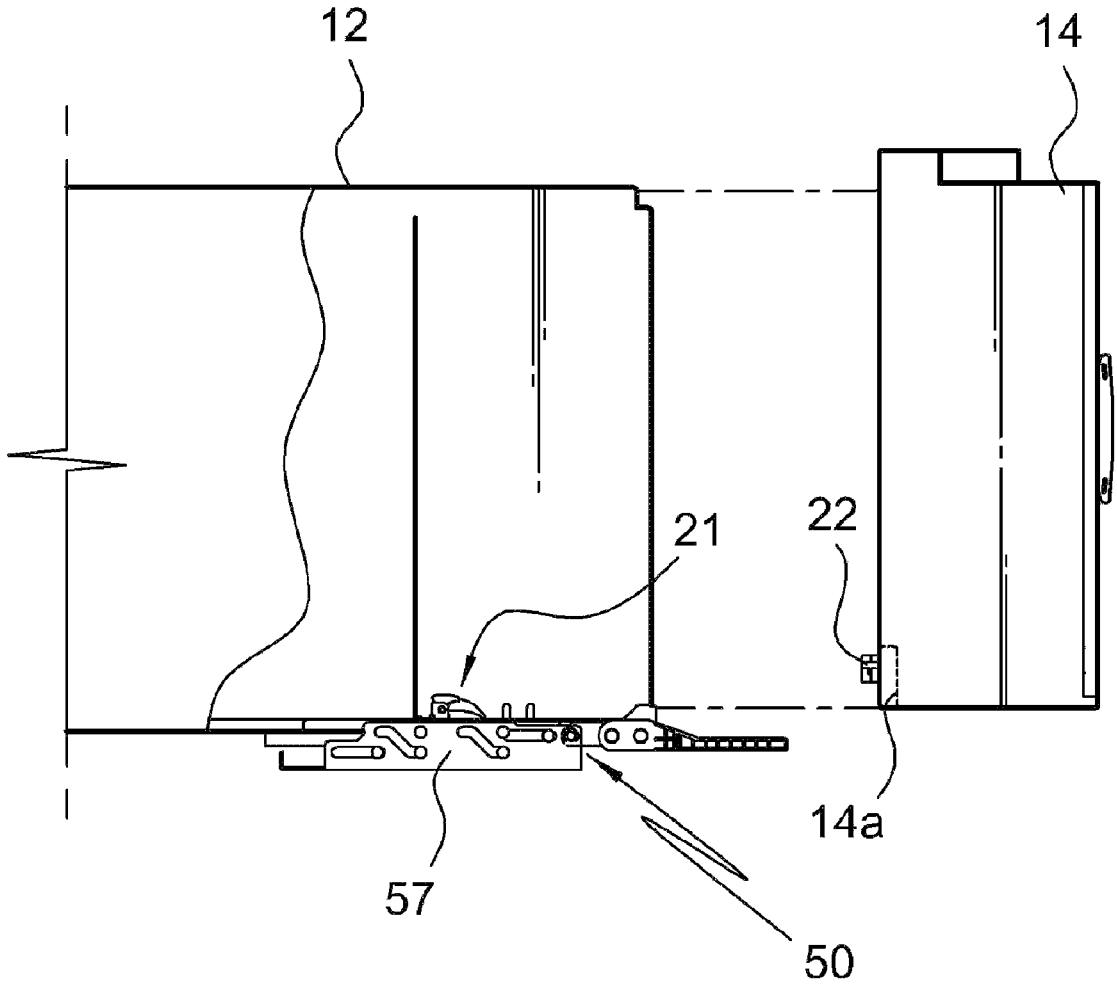
FIG. 7 shows another embodiment of a connector according to the present invention.
Figure 8:
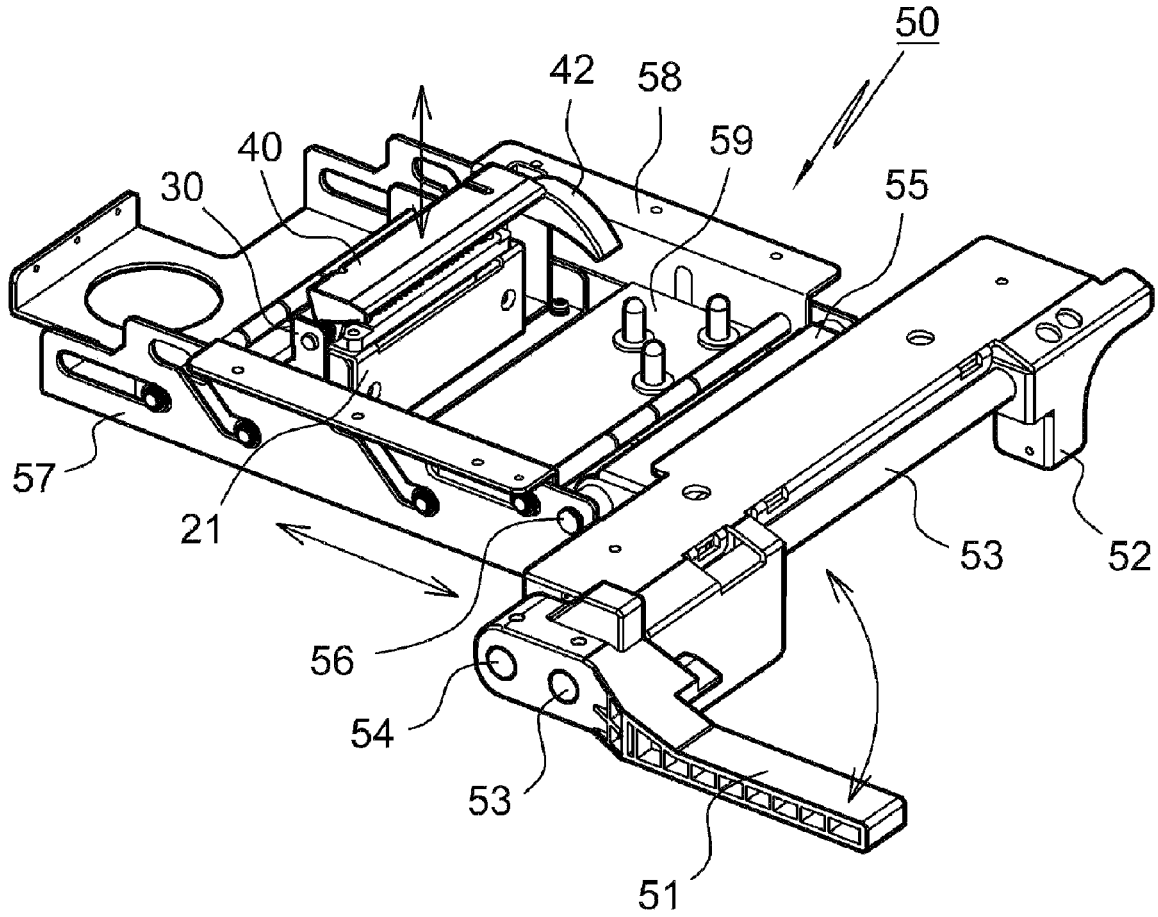
FIG. 8 is a perspective view illustrating a connector conveyor for upwardly and downwardly conveying a connector assembled with a cover according to the present invention.
Figure 9:
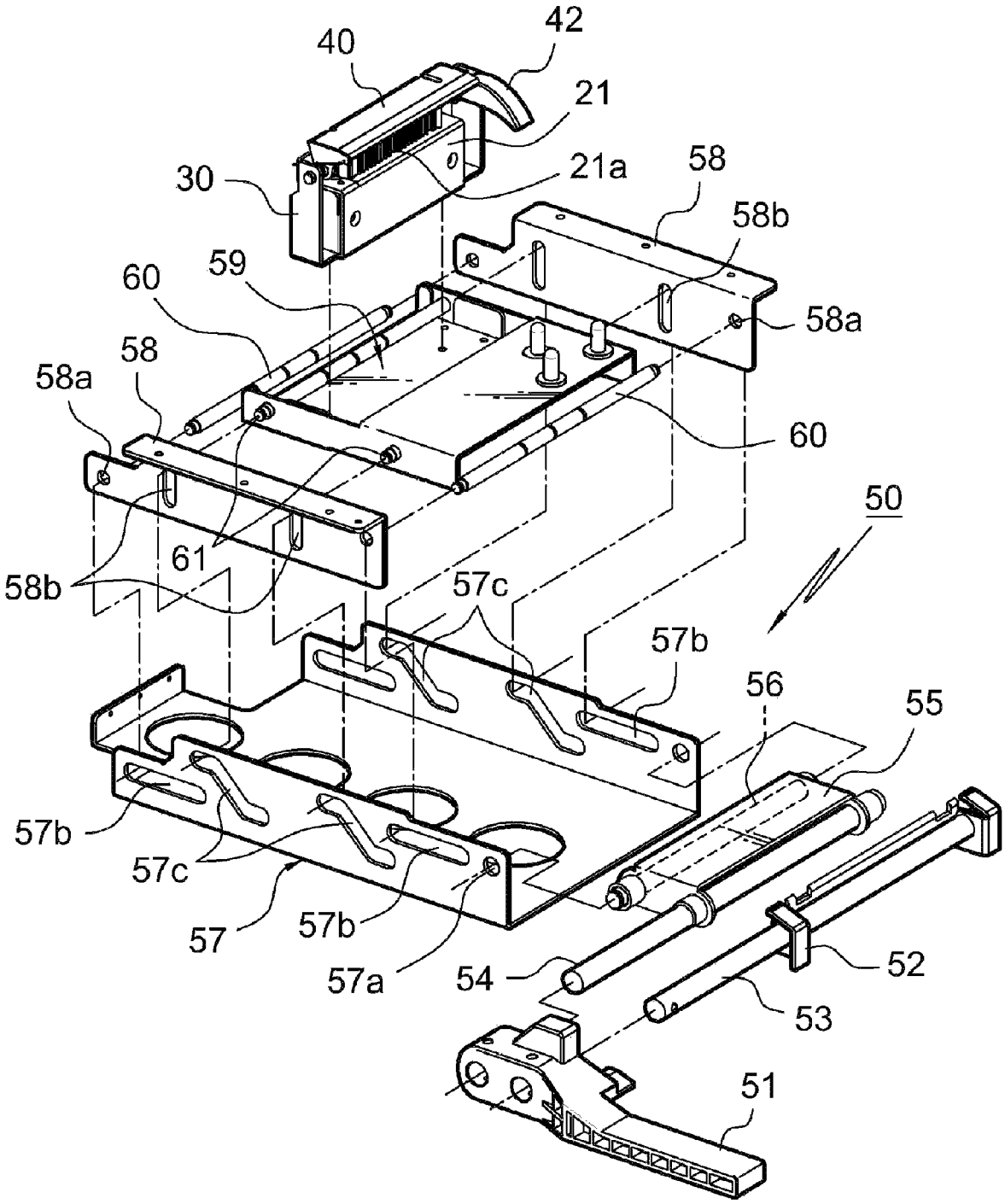
FIG. 9 is an exploded perspective view of FIG. 8.
Figure 10:
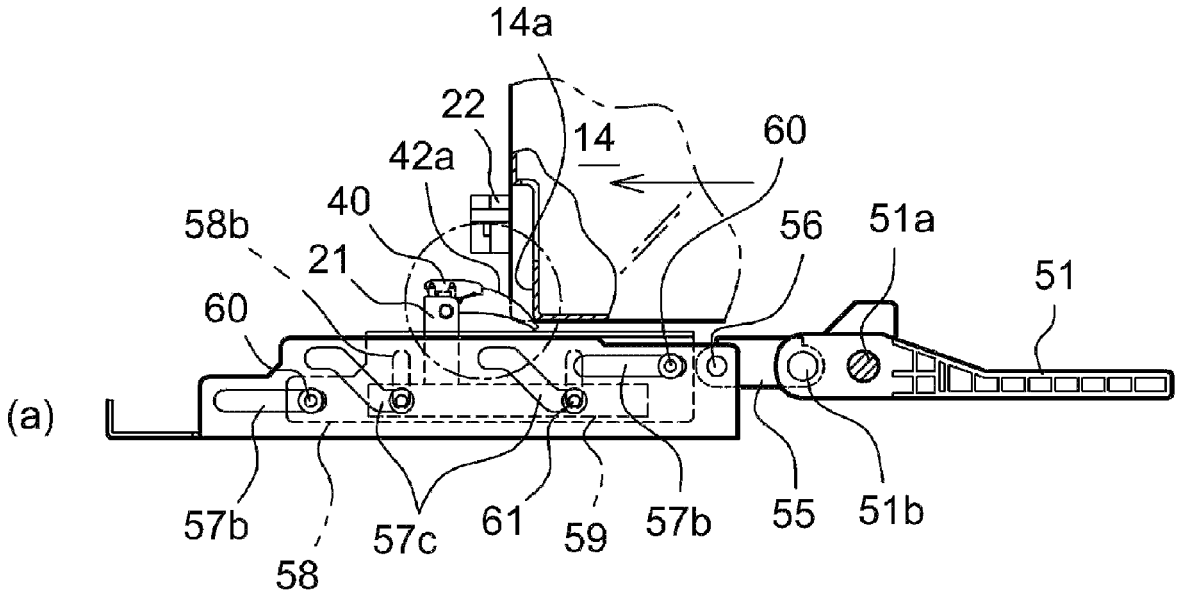
FIGS. 10*a* and 10*b* are side views illustrating a process of assembling a connector according to another embodiment of the present invention.
Figure 10:
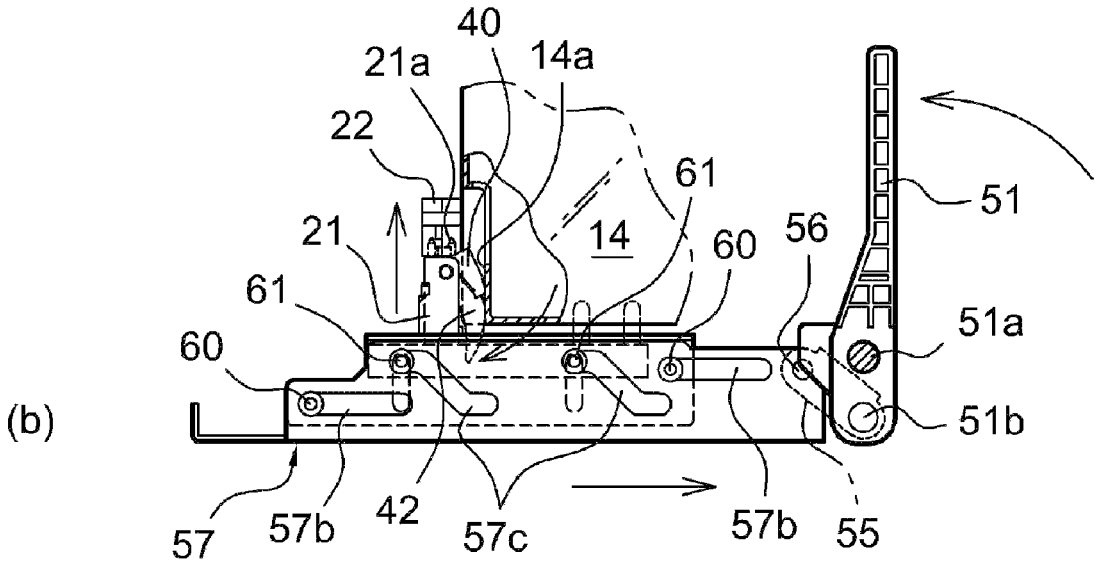

FIG. 7 shows another embodiment of a connector according to the present invention; FIG. 8 is a perspective view illustrating a connector conveyor for upwardly and downwardly conveying a connector; FIG. 9 is an exploded perspective view of FIG. 8; FIGS. 10*a* and 10*b* are side views illustrating a process of assembling a connector.

As shown in FIG. 7, in a bill storage box 12, a cassette box 14 is configured to be laterally mounted and dismounted. Herein, the mounted cassette box 14 may clash with a male connector 21 on the bottom surface of the bill storage box 12, and thus cause the breakage of the male connector 21. Therefore, in this embodiment, there is provided a connector conveyor 50 for downwardly conveying the male connector 21, thereby preventing the clash.

As shown in FIGS. 8 and 9, the connector conveyor 50 includes an operating lever 51, a horizontal conveyor 57, fixed brackets 58, and a vertical conveyor 59.

The operating lever 51 is rotatably assembled to a fixed frame 52 on the axis of a hinge shaft 53. A connecting shaft 54 is spaced apart from the hinge shaft 53 by a predetermined distance, and is rotatably assembled with assembling holes 57*a* of the horizontal conveyor 57 through a connecting part 55 and a connecting shaft 56.

The horizontal conveyor 57 has horizontal guide holes 57*b*, and inclined guide holes 57*c*, on opposite sides.

The fixed brackets 58 are fixedly assembled to the bottom surface of the bill storage box 12. The fixed brackets 58 have assembling holes 58*a* and vertical guide holes 58*b* perpendicular to the assembling holes 58*a*, on opposite sides of the brackets. Herein, connecting shafts 60 are fitted in the assembling holes 58*a* of the fixed brackets 58 and are slidably inserted in the horizontal guide holes 57*b* of the horizontal conveyor 57, so as to interconnect the assembling holes 58*a* and the horizontal guide holes 57*b* while allowing relative sliding between them.

Also, between the opposite fixed brackets 58, connecting shafts 61 assembled with the vertical conveyor 59 are fitted in the vertical guide holes 58*b* of the fixed brackets 58, and are slidably inserted in the inclined guide holes 57*c* of the horizontal conveyor 57, so as to interconnect the vertical guide holes 58*b* and the inclined guide holes 57*c*. Therefore, when the horizontal conveyor 57 moves in left and right directions, the connecting shafts 61 inserted in the inclined guide holes 57*c* and the vertical guide holes 58*b* on the fixed brackets 58, can be moved up and down within a predetermined distance. Then, the vertical conveyor 59 fixedly assembled to the connecting shafts 61, and the male connector 21 are conveyed upward and downward together with the connecting shafts 61.

As shown in FIG. 10*a*, in the connector cover structure provided with the connector conveyor 50 as described above, when the cassette box 14 is laterally mounted, the male connector 21 is conveyed downward by downward operation of the operating lever 51, and then the cassette box 14 is pushed in as deeply as possible. Therefore, it is possible to prevent the clash of the cassette box 14 with the male connector 21. Herein, a contact surface 14*a* of the cassette box 14 presses a contact surface 42*a* of a cover 40, thereby rotating the cover 40 in one direction.

Referring to FIG. 10*b*, at the moment when a contact part 42 of the cover 40 is pressed, a connecting pin 21*a* of the male connector 21 is released. Then, when the operating lever 51 is upwardly operated, the male connector 21 is upwardly conveyed by a link structure of the connector conveyor 50, and thus is assembled to a female connector 22 of the cassette box 14.

On the other hand, when the operating lever 51 is downwardly operated, the male connector 21 is downwardly conveyed, and thus is detached from the female connector 22. Herein, the force pressing the contact part 42 of the cover 40 is released, so that the cover 40 can be returned to its original position by elastic force of elastic springs 45.

INDUSTRIAL APPLICABILITY

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A structure for covering a connector of a bill storage box connected to or disconnected from a mating connector of a cassette box during a process of mounting or dismounting the cassette box in or from the bill storage box, the structure comprising:

a connector-fixing bracket attached to the bill storage box to fix the connector, and having assembling holes formed through opposite sides of the connector-fixing bracket;

a hinge shaft rotatably fitted in the assembling holes of the connector-fixing bracket;

a contact part with a curved shape protruded by a certain length forward from one end of the cover and connected to the cover to be integrally rotated with the cover; and elastic members assembled to the hinge shaft to continuously urge the cover to a position at which the cover covers a connecting pin, wherein the contact part is arranged such that when the cassette box is mounted to the bill storage box from upper side or lateral side, the contact part is pressed by one end of the cassette box and rotated to open the connecting pin, and wherein the elastic members are arranged such that when the connector of the bill storage box is disconnected from the mating connector of the cassette box, the cover is rotated to cover the connecting pin by the force of elastic members.

2. The structure for covering the connector of the bill storage box as claimed in claim 1 wherein a lower end portion of the contact part is lower than a center of the hinge shaft of the cover.

3. The structure for covering the connector of the bill storage box as claimed in claim 1 wherein the connector-fixing bracket comprises stopper pieces formed on opposite sides of the connector-fixing bracket so as to limit rotation of the cover.

* * * * *